United States Patent [19]

Brown

[11] 3,967,602

[45] July 6, 1976

[54] HYDRAULIC VALVE LIFTER FOR RECIPROCATING INTERNAL COMBUSTION ENGINES

[76] Inventor: William G. Brown, 601 E. Angeleno Ave., Apt. O, Burbank, Calif. 91501

[22] Filed: Sept. 23, 1974

[21] Appl. No.: 508,145

Related U.S. Application Data

[63] Continuation-in-part of Ser. No. 477,615, June 10, 1974.

[52] U.S. Cl. ..... 123/90.55; 123/90.34; 123/90.35; 123/90.56

[51] Int. Cl.[2] ..... F01L 1/14

[58] Field of Search..... 123/90.34, 90.35, 90.55, 123/90.56, 90.57, 90.58, 90.59, 90.15, 90.16

[56] References Cited

UNITED STATES PATENTS

| | | | |
|---|---|---|---|
| 1,442,698 | 1/1923 | Page | 123/90.34 |
| 1,741,230 | 12/1929 | Goodwin | 123/90.35 |
| 2,036,936 | 4/1936 | Halford | 123/90.56 |
| 2,309,740 | 2/1943 | Voorhies | 123/90.56 |
| 2,765,783 | 10/1956 | Randol | 123/90.34 |
| 2,840,063 | 6/1958 | Purchas | 123/90.55 |
| 3,176,669 | 4/1965 | Kuchen | 123/90.35 |
| 3,291,107 | 12/1966 | Cornell | 123/90.55 |
| 3,299,986 | 1/1967 | Briggs | 123/90.34 |
| 3,304,925 | 2/1967 | Rhoads | 123/90.55 |
| 3,742,921 | 7/1973 | Rendine | 123/90.55 |

*Primary Examiner*—Charles J. Myhre
*Assistant Examiner*—Daniel J. O'Connor
*Attorney, Agent, or Firm*—Christie, Parker & Hale

[57] ABSTRACT

A hydraulic valve lifter for a reciprocating internal combustion engine has a displaceable plunger within a body for coupling a cam lobe with a push rod in a valve train. The cam lobe acts on the base of the body. A cavity within the plunger receives oil from the engine's oil supply and delivers oil through a check valve to a second cavity outside the plunger and within the body. Oil in the second cavity force couples the plunger and the cam lobe. The volume of oil in the second cavity determines the position of the plunger. A controlled leak path from the second cavity and through the base of the body allows oil to leave the second cavity at a controlled rate. Leakage at low engine speeds prevents complete lift of the plunger, and valve overlap and lift are reduced over that which occurs at full lift. At higher engine speeds, the flow of oil into the second cavity exceeds the flow of oil out through the leak path to lift the plunger and increase exhaust and intake valve overlap and valve lift, and valve duration. (Valve duration is defined as the time, usually expressed in crankshaft degrees, the valves are open.) At all engine speeds the leakage lubricates the surfaces of the body and the cam lobe which contact each other.

4 Claims, 2 Drawing Figures

HYDRAULIC VALVE LIFTER FOR RECIPROCATING INTERNAL COMBUSTION ENGINES

CROSS-REFERENCE TO RELATED APPLICATION

This is a continuation-in-part application of application Ser. No. 477,615, filed June 10, 1974.

BACKGROUND OF THE INVENTION

The present invention relates to hydraulic valve lifters for use in reciprocating internal combustion engines, and, more in particular, to a hydraulic valve lifter having a controlled oil leak path to reduce the lift of the lifter at low engine speeds while permitting full lift at some higher engine speed for maximum inlet and exhaust valve overlap, valve lift and valve duration. Leakage also lubricates the surface of the lifter and a cam which contact each other.

A reciprocating internal combustion engine has a number of cylinders, each of which has an inlet valve and an exhaust valve for admitting a combustible mixture and exhausting products of combustion, respectively. Pistons in the cylinders are agents for inducting combustible mixture into the cylinders by suction, and for forcing exhaust products from the cylinders by displacement. In a cylinder of a modern engine, an inlet valve begins to open while an exhaust valve is still open, but closes during the time that the piston of the cylinder is ending an upward stroke and beginning a downward one. When both exhaust and inlet valves are open at the same time there is valve overlap.

Today's focus on engine emission problems is well known. The pollutants of most concern are unburned hydrocarbons, the oxides of nitrogen ($NO_x$), and carbon monoxide.

In the general case, unburned hydrocarbon and carbon monoxide pollutants are reduced with lower valve overlap and valve open durations. The reasons for this favorable result include a longer duration of time during a cycle that the combustion chambers are closed and, therefore, a longer time for completing combustion at higher average combustion temperatures. At higher temperatures, combustion rates are faster. The longer the time and the faster the rate, the more complete the combustion.

In the general case, with valve overlap and at normally encountered engine speeds, higher pressure in the exhaust side of an engine over the pressure in the induction or inlet side of the engine will force exhaust products back into a combustion chamber. This lowers combustion temperatures because the presence of exhaust products precludes the presence of a corresponding amount of combustible mixture. With lower combustion temperatures, oxides of nitrogen generated during the combustion process are reduced because the reaction rate of the reactants which produce the oxides decreases dramatically as temperature is lowered.

While valve overlap has advantages at relatively high engine speeds, it generally adversely affects engine operation at low engine speeds, pollution considerations aside.

To accommodate the different operating conditions of an engine and to get satisfactory engine performance throughout the engine's speed range, elaborate mechanisms have been proposed for varying the degree of valve overlap between a condition where extremely low overlap occurs at low engine speeds to a condition where the overlap is greater at high engines speeds. It is recognized that the proposed systems are elaborate, complex, and require considerable development. See Freeman and Nicholson, Valve Timing for Control of Oxides of Nitrogen ($NO_x$), Society of Automotive Engineers, Paper 720121 (1972). It has been known for some time that a large amount of valve overlap at high engine speeds dramatically increases an engine's power performance. Large valve overlap admits to a greater mass of fuel and air in a combustion chamber at operating conditions where the inertia of exhausting products of combustion overcomes the effect of exhaust gas pressure to keep products of combustion from reentering the combustion chamber from the exhaust system. In this high performance application it has also been recognized that large valve overlap produces very poor to totally unsatisfactory idle performance and poor driveability. In this application, proposals have been made to use hydraulic valve lifters as a vehicle for varying the amount of valve overlap as a function of engine speed (from a condition of low overlap to high overlap with increasing engine speed). In U.S. Pat. No. 3,304,925 to Rhodes, for example, a hydraulic valve lifter is disclosed having two chambers communicating through a check valve with oil in one of the chambers being in series force relationship in the valve train, as is standard in hydraulic valve lifters. Rhodes' valve lifter provides a controlled release of pressure from this chamber to a channel between the lifter's plunger and lifter body. This release of pressure occurs only above a certain threshold engine speed and diminishes gradually thereafter with increasing engine speed to increase valve lift and valve overlap. In U.S. Pat. No. 2,614,547 to Meinecke a hydraulic valve lifter is disclosed which provides increasing valve overlap with increasing engine speed by gradually increasing the oil pressure in a chamber of the valve lifter in which oil is in series force relationship in the valve train. At low engine speeds the Meinecke valve lifter discharges oil from the chamber externally of the valve lifter. The same type of arrangement is disclosed in U.S. Pat. No. 2,931,347 to Williams.

SUMMARY OF THE INVENTION

The present invention provides an improved valve lifter with functions to provide low valve overlap, valve lift and valve open duration at low to moderate engine speeds. As engine speed increases, valve overlap, valve lift, and valve open duration also increase. The result improves driveability, economy, power and hydrocarbon and carbon monoxide emissions at low and moderate engine speeds. At higher engine speeds, increased valve overlap, valve lift and valve open duration improve power and reduce nitrogen oxide emissions.

The hydraulic valve lifter of the present invention has a first fluid receiving cavity and a second fluid receiving cavity. These cavities are in communication with each other in a standard manner to position a plunger within a lifter body when a cam lobe is acting on a cam face of the lifter body. Typically the fluid is an engine's oil. Again as is standard, oil in one of the two cavities, say the first cavity, is in series force relationship in the valve train in which the hydraulic valve lifter is present. The alternate or second cavity supplies oil to the first cavity to lift the plunger and increase valve lift, valve open duration and valve overlap. Means is provided to communicate the second cavity and an engine's pressurized oil system. A controlled leak path through the lifter from the first cavity and onto the cam lobe passes oil from lifter to reduce the effective length of the valve lifter in the valve train and lubricate the cam lobe and lifter where they engage. This reduction in length results in a reduction of inlet and exhaust valve overlap, valve open duration, and valve lift. Accordingly, at low and moderate engine speeds an engine equipped with the valve lifter of the present invention will perform without the problem associated with valve overlap at low speeds. The controlled leak path is restricted enough such that at higher engine speeds the force of the engine's oil pump, which increases with engine speed, effectively overcomes the leak path and fills the cavity in series force relationship in the valve train with oil to increase the effective length of the valve lifter. Ultimately, at some predetermined speed, the length of the lifter will reach a maximum and valve overlap and valve open duration will be at a maximum. Thus, at high engine speeds the benefits of greater valve open duration, overlap and lift are present.

A particular form of the hydraulic valve lifter of the present invention has two fluid receiving cavities in communication with each other in a standard manner to position a plunger within a lifter body when a cam lob is acting on a cam face of the lifter body. Typically the fluid is an engine's oil. Again as is standard, oil in one of the two cavities is in series force relationship in the valve train in which the hydraulic valve lifter is present. Means is provided to communicate the alternate cavity and an engine's pressurized oil system. A controlled leak path between the cavity in series force relationship in the valve train and the outside of the body through the cam face onto the cam lobe reduces the effective length of the valve lifter in the train as an inverse function of engine speed. This reduction in length occurs at low engine speeds and reduces or eliminates inlet and exhaust valve overlap. It also reduces valve open duration. Accordingly, at low engine speeds an engine equipped with the valve lifter of the present invention will have optimum performance without the problems associated with excessive valve overlap at low speeds. The controlled leak path is such that at high engine speeds the force of the engine's oil pump, which increases with engine speed, effectively overcomes the leak path and fills the cavity in series force relationship with oil to increase the effective length of the valve lifter. Ultimately, at some predetermined speed, the length of the lifter will reach a maximum and valve overlap and valve open duration will be at a maximum.

Oil which has passed through the controlled leak path and onto the cam lobe lubricates these highly stressed interfaced surfaces of the lobe and the lifter.

Means may be provided to prevent excessive valve lash at very low engine speeds such as a stop for the plunger in the force transmitting cavity. The stop can be a washer or an extension of the lifter plunger. Preferably, the washer is of the Bellville type. It can also be an elastomer. In some cases, perhaps in most, valve lash is not a problem and the spacer need not be provided.

The preferred embodiments of the present invention all have a standard check valve to feed oil from the alternate cavity to the cavity in which oil is in series force relationship within the valve train and a plunger return spring. A push rod seat and oil metering valve cap the plunger.

These and other features, aspects and advantages of the present invention will become more apparent from the following description, appended claims and drawings.

DESCRIPTION OF THE PREFERRED EMBODIMENT

Figure 1:
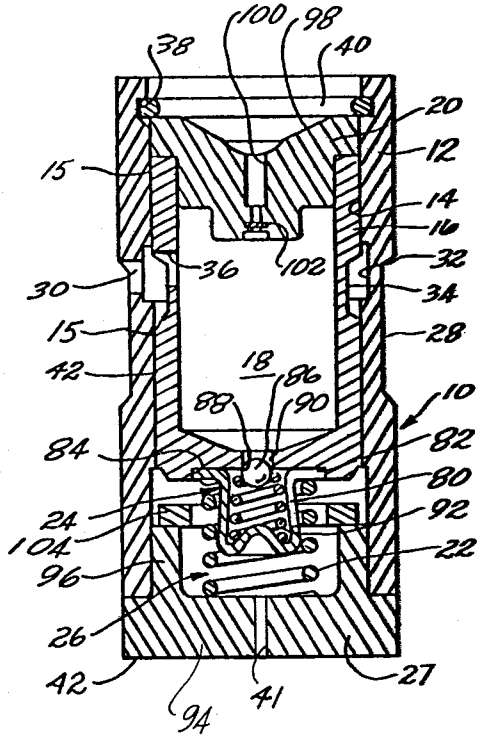
FIG. 1 is an elevational, half-sectional view of the preferred embodiment of the hydraulic valve lifter of the present invention.

With reference to FIG. 1, an improved hydraulic valve lifter 10 in accordance with the present invention is illustrated. The valve lifter includes a body 12 which has an axial bore 14. A plunger 16 is translationally disposed in the bore and is guided by lands 15 of the plunger on the wall of bore 14. The plunger is hollow and defines an upper chamber or cavity 18. A push rod seat and oil metering valve assembly 20 caps the top of the plunger. A plunger return spring 22 acts between a lower surface of the plunger and an interior surface of the body to bias the plunger upward. A check valve assembly 24 is carried by the plunger to control the flow of oil from upper cavity 18 into a lower chamber or cavity 26. The lower cavity is defined by interior walls of the body and the lower horizontal wall of the plunger. The body has a base 27 which contacts a cam lobe.

An annular channel 28 on the outside of body 12 is positioned to register periodically with an oil gallery of the engine in which the lifter finds itself. An oil entry port 30 from channel 28 opens into bore 14. An annular interior channel 32 within bore 14 but having a greater diameter than the bore meets inlet port 30. An external channel 34 on the outer surface of plunger 16 registers with port 30 and channel 32. An oil inlet port 36 through the wall of plunger 16 communicates cavity 18 with channels 32 and 34, and port 30, and ultimately the source of pressurizing oil of the engine.

An annular groove 38 within bore 14 at the top of body 12 receives a snap ring 40 for retaining the assembly of components within bore 14.

What has been described to this point is a standard hydraulic valve lifter. The standard valve lifter operates in the following manner. Oil from the engine's oil gallery and under pressure by reason of the engine's oil pump enters inlet port 30. From port 30 the oil passes into and through channel 32, plunger channel 34, oil inlet port 36, and fills upper cavity 18. Check valve 24 allows oil to pass from cavity 18 into cavity 26, but not in the opposite direction.

The valve lifter is in a valve train between either an inlet or an exhaust valve and a cam lobe which opens the valve. The train includes the valve, a valve spring urging the valve closed, a rocker arm acting directly on the valve and in series force relationship with the valve and valve spring, a push rod acting directly on the rocker arm and in a series force relationship with the rocker arm, plunger 16 acting directly on the push rod and in series force relationship therewith, oil within cavity 26 acting directly in series force relationship on plunger 16, base 27 of body 12 acting in series directly on oil cavity 26, and the cam lobe acting serially directly on base 27. As the cam lobe increasingly bears on base 27, lifter body 12 begins to rise. The force of the valve train on the plunger, however, tends to force the plunger downwardly with respect to the lifter body. Oil from the engine's lubricating system entering cavity 18 will pass through check valve 24 to enter cavity 26. This oil will eventually fill cavity 26 and "pump up" the lifter so that the plunger is at its most elevated position in the body, the position illustrated in FIG. 1.

The present invention modifies the valve lifter just discussed by providing a controlled leak path between cavity 26 and the exterior of the lifter through base 27 and through a small passage 41. This passage is positioned to discharge oil directly on the cam lobe and to lubricate the surface of the lobe and a cam following surface or face 42 of base 27, surface 42 directly contacting the cam lobe.

The leak path between lower cavity 26 through passage 41 and out through surface 42 permits the lifter not to pump up at low to moderate engine speeds. In other words and with reference to FIG. 1, plunger 16 during the opening of a valve will be lower in the lifter body than illustrated. The rate of oil leakage through passage 41 can be varied by controlling the resistance to flow along this path. An easy way to do this is by varying the diameter of passage 41. Passage 41 has a diameter to restrict leakage through it so that at a predetermined engine speed the lifter is fully pumped up. The diameter of passage 41 will be varied to suit the engine speed that full pump up is desired, the lifter's natural leak down rate and the load on the valve train.

Figure 2:
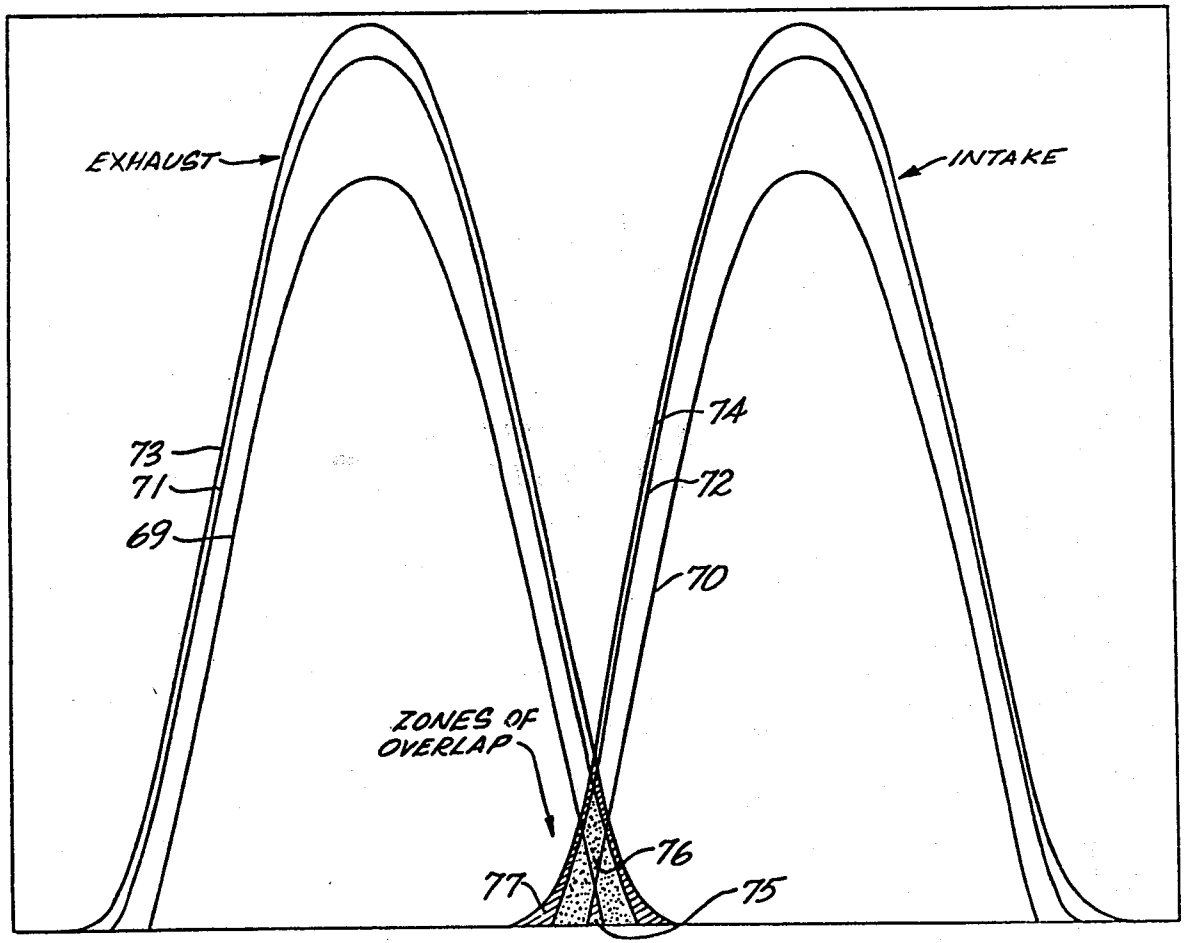
FIG. 2 is a graphical depiction of the effect of the valve lifter of the present invention illustrating valve lift, the ordinate, versus crank degrees, the abscissa.

The effect of not permitting valve lifters to fully pump up at low to moderate engine speeds is illustrated in FIG. 2 for both exhaust and inlet valves.

A curve 69 and a curve 70 illustrate the lift produced by a valve lifter in accordance with the present invention for an exhaust and an intake valve, respectively, at very slow engine speeds associated with, for example, idle. Curves 71 and 72 indicate the amount of lift for an exhaust and an intake valve at a greater but moderate speed.

Curves 73 and 74 illustrate the maximum lift of the exhaust and intake valves. As previously discussed, most modern engines provide for some overlap between the inlet and the exhaust valve for improved high speed performance of the engine. As was also previously discussed, it is known that valve overlap can be used to lower the amount of the oxides of nitrogen generated by internal combustion engines. At lower engine speeds, a reduction in valve overlap normally brings about reductions in hydrocarbon and carbon monoxide emissions. Lower overlap also improves driveability. Tests indicate that with relatively low overlap at low and moderate engine speeds there are improvements in both horsepower and fuel economy.

The present invention provides for very little valve overlap at idle conditions. The amount of overlap is shown by sectioned area 75, the area below the point where curves 69 and 70 cross and which is embraced by these curves. The intermediate valve openings illustrated show overlap in stippled and sectioned areas 76 below the intersection of curves 71 and 72 and within the curves. Area 76, obviously, includes area 75. The maximum amount of overlap is shown by the largest sectioned and stippled area 77 and the area is below the intercept of the two curves 73 and 74 and within them. Area 77 includes areas 75 and 76.

Summarizing FIG. 2, the leak through leak path 41 is slow enough that at high engine speeds and with the oil pressure of an engine at these speeds the rate of oil leakage from the lower cavity out to the outside of the lifter is lower than the rate at which oil wants to enter the lower cavity from the plunger cavity. Consequently at these speeds the lower cavity of the lifter is filled, the plunger is in its fully extended position, and the effective length of the lifter is at its maximum. At low engine speeds the oil can escape from the lower cavity faster than the oil enters the lower cavity and the lifter does not pump up. At intermediate engine speeds there will be some pump up but not complete pump up.

Completing the description of the hydraulic valve lifter illustrated in FIG. 1, check valve 24 has a cage 80 secured to the plunger by resilient tabs 82 engaging the vertical wall of a counterbore 84 in the bottom of the plunger. A ball 86 rests on a seat 88 at the lower end of an axial oil passage 90. A spring 92 acts between ball 86 and the inside of the cage to bias the ball onto the seat.

A lower hardened cam follower cap 94 constitutes base 27 and has an annular, axially extending plug section 96 received in a lower portion of bore 14 with an interference fit.

Push rod seat and oil metering valve assembly 20 caps the upper end of cavity 18 and rests on plunger 16. The push rod seat and oil metering valve assembly includes a push rod seat 98 formed of a generally spherical surface which at its center opens into oil passage 100. This oil passage leads to an oil metering valve 102 which permits oil from cavity 18 to lubricate the surface of seat 98 and the cooperating surface of a push rod and through a hollow push rod to the rocker arm area in the cylinder head.

Because of the leak path of the valve lifter of the present invention it is possible that the force of the valve spring acting on the lifter will force plunger 16 too far down in bore 14, resulting in excessive valve train lash. To prevent this, a spacer 104 is provided to ride on the upper horizontal surface of plug section 96 for engagement by the lower end of the plunger. Spacer 104 could be an extension of plug section 96 or an extension of plunger 16. Spacer 104 preferably yields elastically under compression by the plunger and plug section to cushion impact and reduce noise and wear. For this purpose spacer 104 can be a Bellville type spring or even an elastomer. Normally, however, spring 22 can prevent complete bottoming and no spacer at all is required. Stated differently, in most applications valve train lash is not a problem and therefore nothing need be done to correct for it.

It should be appreciated that the leak rate from the lower cavity through passage 41 and onto the cam lobe and natural leakage by the lower of lands 15 depends on the resistance along the leak path to oil flow, and the force which is acting on the oil to force it through these leak paths. The latter of course depends on the force acting on the plunger by the push rod less the return force of the return spring in the lower cavity. In any event, the size of leak path 41 to effect the purpose of the present invention will vary depending on the particular engine in which the improved hydraulic valve lifter is to be used. In one application with a 350 cubic inch Chevrolet engine full pump occurred between 3500 and 4000 RPM. Depending on the application, an engine may have both its exhaust and intake valves adapted with the valve lifter of the present invention, or either of them separately. It must also be appreciated that for optimum results with a given engine all components which affect induction and exhaust must be optimized with the lifters.

The present invention has been described with reference to certain embodiments. The spirit and scope of the appended claims should not, however, necessarily be limited to the foregoing description.

What is claimed is:

1. An improved hydraulic valve lifter of the type having a lifter body with an axial bore, a base of the lifter body, a cam following face on the base for engagement by the lobe of a cam, a plunger axially displaceable within the axial bore of the lifter body between a first position close to the base of the lifter body and a second position remote from the base, the plunger being for acting on a push rod, a fluid receiving cavity in the axial bore of the lifter body and in series force relationship between the lifter body base and the plunger, and means for providing fluid to the fluid receiving cavity to lift the plunger in the axial bore of the lifter body, the improvement which comprises;

a leak path means between the fluid receiving cavity and the outside of the valve lifter through the base of the lifter body and the cam following face, the leak path means being sufficient to prevent the cavity from filling with fluid from the fluid providing means during low to moderate engine speeds and thereby preventing the plunger from reaching its second position, but being restricted enough to allow the cavity to fill with fluid from the fluid providing means at a predetermined, greater engine speed and to thereby force the plunger into its second position.

2. The improvement claimed in claim 1 wherein the leak path is defined by a constantly open passage through the base opening where the cam lobe engages the cam following face.

3. An improved hydraulic valve lifter comprising:

a. a lifter body having an axial bore, a base of the body at the bottom of the bore, and a cam follower face on the base for the lobe of a cam to engage;

b. a plunger translationally disposed in the axial bore and having a first cavity therein, the bottom of the plunger defining with the wall of the axial bore of the lifter body and the base of the lifter body a second cavity for receipt of fluid passed from the first cavity, the fluid in the second cavity being to act in series in a valve train between the plunger and the lifter body and to translate the plunger in the axial bore from a first position proximate the base and a second, elevated position remote from the base;

c. a check valve between the first and second cavities to pass the fluid from the first cavity to the second cavity and to prevent fluid from flowing from the second cavity to the first cavity;

d. a plunger return spring between the body and the plunger to urge the plunger into an elevated position within the bore of the body;

e. a push rod seat on the plunger for engaging a push rod;

f. means for retaining the push rod seat, plunger, check valve and return spring in the bore of the body; and g. a leak path means between the second cavity and the outside of the valve lifter through the cam follower base to provide a controlled leak from the second cavity and prevent the second cavity from filling with the fluid passed from the first cavity and lifting the plunger to its fully elevated position during predetermined low to moderate engine speeds and to permit such filling of the second cavity above the predetermined engine speed to raise the plunger to its fully elevated position and provide the maximum effective length of the valve lifter.

4. The improved hydraulic valve lifter claimed in claim 3 wherein the leak path is a constantly open passage through the base for providing lubrication for the cam lobe and valve lifter at the interface between the two.

* * * * *